US005505026A

United States Patent [19]

Fausto

[11] Patent Number: 5,505,026

[45] Date of Patent: Apr. 9, 1996

[54] ASEISMATIC LOAD-SUPPORTING STRUCTURE FOR ELEVATED CONSTRUCTIONS

[76] Inventor: Intilla Fausto, Via Camoghé , 6593 Cadenazzo, Switzerland

[21] Appl. No.: 387,276

[22] Filed: Feb. 13, 1995

[30] Foreign Application Priority Data

Feb. 22, 1994 [CH] Switzerland ..... 00 513/94

[51] Int. Cl.[6] ..... F04H 9/02; F02D 27/34

[52] U.S. Cl. ..... 52/167.4; 52/167.5; 52/167.7; 14/73.5

[58] Field of Search ..... 52/167.1, 167.3, 52/167.4, 167.5, 167.6, 167.7, 167.8; 14/73.5

[56] References Cited

U.S. PATENT DOCUMENTS

| | | | |
|---|---|---|---|
| 671,199 | 4/1901 | White | 52/779 X |
| 2,743,487 | 5/1956 | Kuhlman | 52/781.3 X |
| 3,606,704 | 9/1971 | Denton | 52/167.8 |
| 4,881,350 | 11/1989 | Wu | 52/167.5 |
| 5,205,528 | 4/1993 | Cunningham | 52/167.4 X |

FOREIGN PATENT DOCUMENTS

| | | | |
|---|---|---|---|
| 1154139 | 9/1963 | Japan | 14/73.5 |
| 3-36375 | 2/1991 | Japan | 52/167.7 |

*Primary Examiner*—Carl D. Friedman
*Assistant Examiner*—Laura A. Saladino
*Attorney, Agent, or Firm*—Helfgott & Karas

[57] ABSTRACT

This invention concerns an aseismatic steel structure for supporting elevated constructions or works to be interposed between a plurality of reinforced concrete supporting pillars and the lower base of a block of the elevated construction. In an embodiment the structure comprises two independent pairs of hollow columns arranged substantially parallel at the four angles of an imaginary square, and coupled by flexible first arcuated members, the block of the elevated construction being supported on such columns through sliding bearings.

The columns are further connected, by sliding couplings, to four flexible arcuated beams, whose lower ends rest on the reinforced concrete supporting pillars, through bearings at the top of the pillars.

6 Claims, 4 Drawing Sheets

ASEISMATIC LOAD-SUPPORTING STRUCTURE FOR ELEVATED CONSTRUCTIONS

BACKGROUND OF THE INVENTION

This invention relates to a load-supporting structure, for supporting elevated or raised constructions, provided with aseismatic, i.e. earthquake-proof features.

When designing elevated structures, such as bridges and road bridges, both the stresses due to fluctuations of the applied load and displacements of the earth surface that are caused by normal ground settling as well as by extraordinary events such as earthquakes must be considered.

An object of the present invention is to provide an earthquake-resistant load-supporting structure for elevated constructions or works that is able to accomodate different loads to which such elevated structure may be subjected, without detriment of the work functionality.

Moreover the invention aims to provide a load-supporting structure able to accomodate displacements due to sudden subsidences, for example caused by earthquakes, while maintaining substantially constant the placement or attitude of such elevated structure with respect to the earth surface.

SUMMARY OF THE INVENTION

These and other objects are accomplished by the present invention through an aseismatic structure for supporting an elevated or raised construction, comprising a block of the elevated structure, a plurality of reinforced concrete base pillars, a plurality of hollow metal columns in a substantially parallel arrangement, supporting the base of said block through slidable bearing means and interconnected two by two through flexible arcuated members, and flexible arcuated beams each having one end connected to one of said base pillars through bearing means at the top thereof, and the other end connected to one of said hollow metal columns through a coupling member one-way axially movable inside said hollow metal column.

Additional features and advantages of the invention will become evident through the description of a preferred, but not exclusive embodiment, illustrated by way of a non-limiting examplary embodiment in the attached drawings.

DESCRIPTION OF A PREFERRED EMBODIMENT

Figure 1:
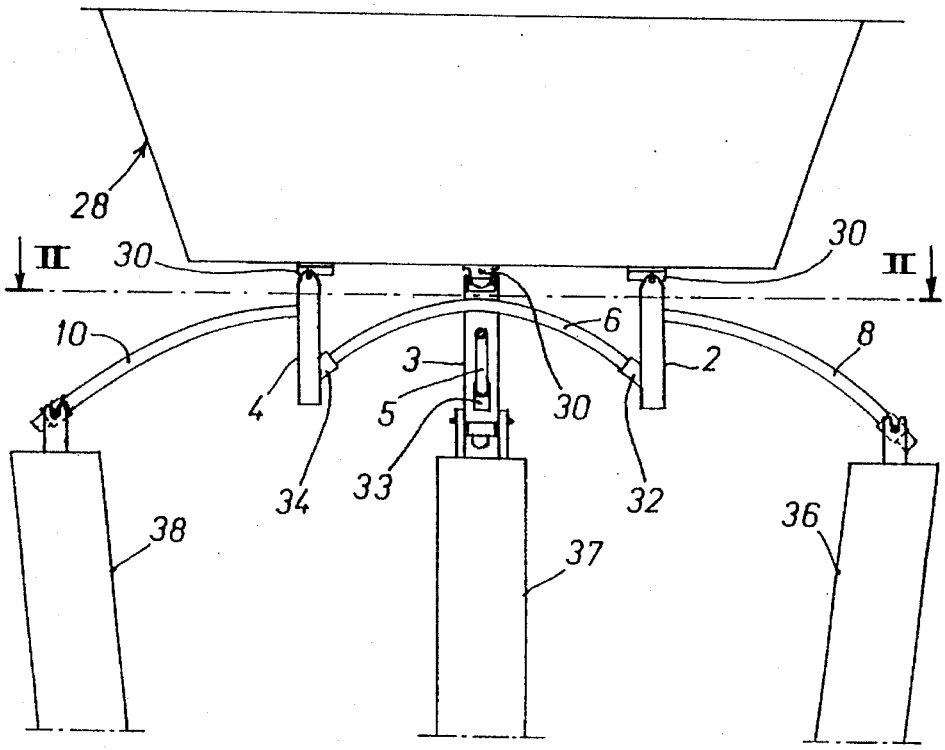
FIG. 1 is a front cross section view of the load-supporting structure of the invention.
Figure 2:
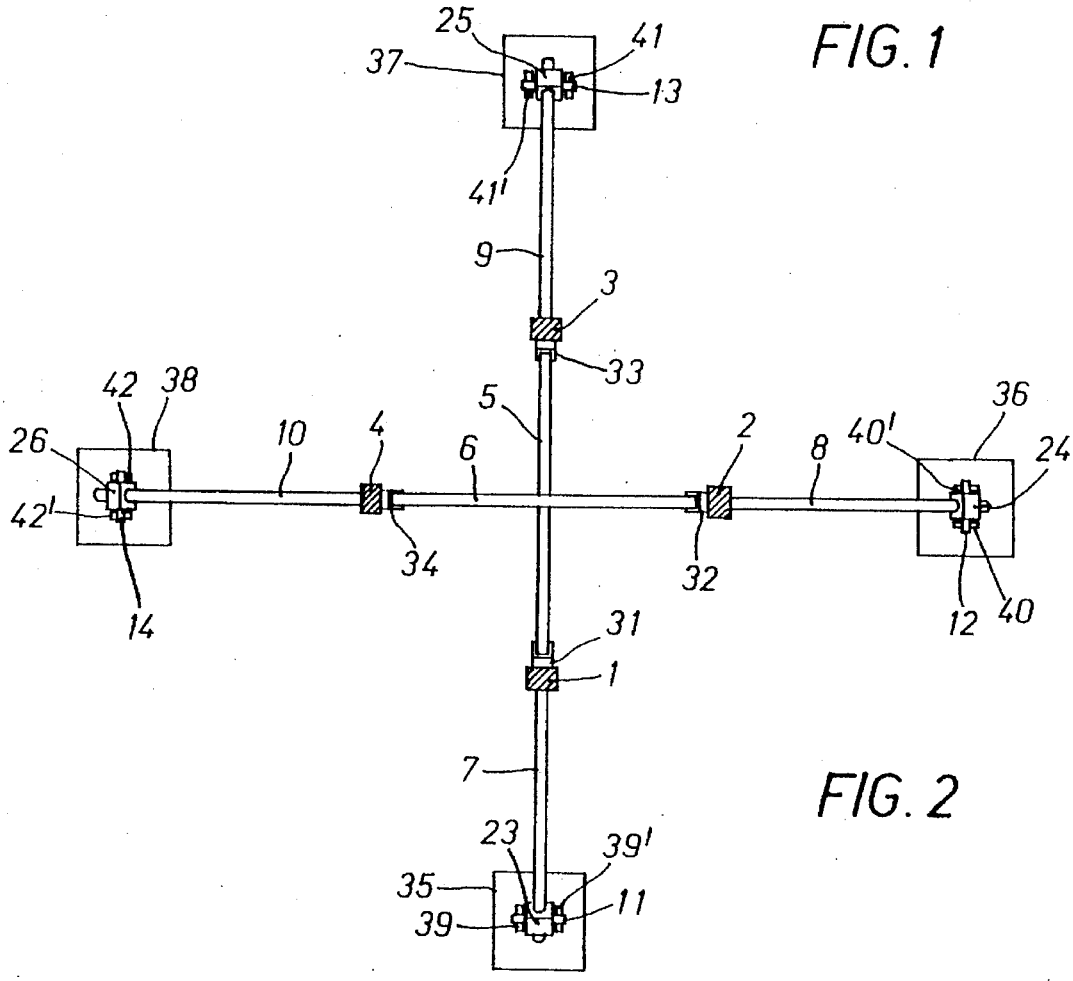
FIG. 2 is a cross section view along line II—II in FIG. 1.

Referring to the accompanying drawings, FIGS. 1 and 2 show a block 28 of an elevated structure (not shown) provided with earthquake-resistant features that is sustained on a plurality of reinforced concrete base pillars 35, 36, 37, 38 through a load-supporting structure according to the invention. The illustrated embodiment of the load-supporting structure comprises two independent pairs of steel hollow columns 1, 2, 3, 4 having a rectangular cross section and provided with an elongated side opening. The columns are located parallel to each other at the corners of an imaginary square, and are connected through slidable bearing means disposed between the upper ends of the hollow columns and the base of the block 28 of the elevated structure.

Figure 3:
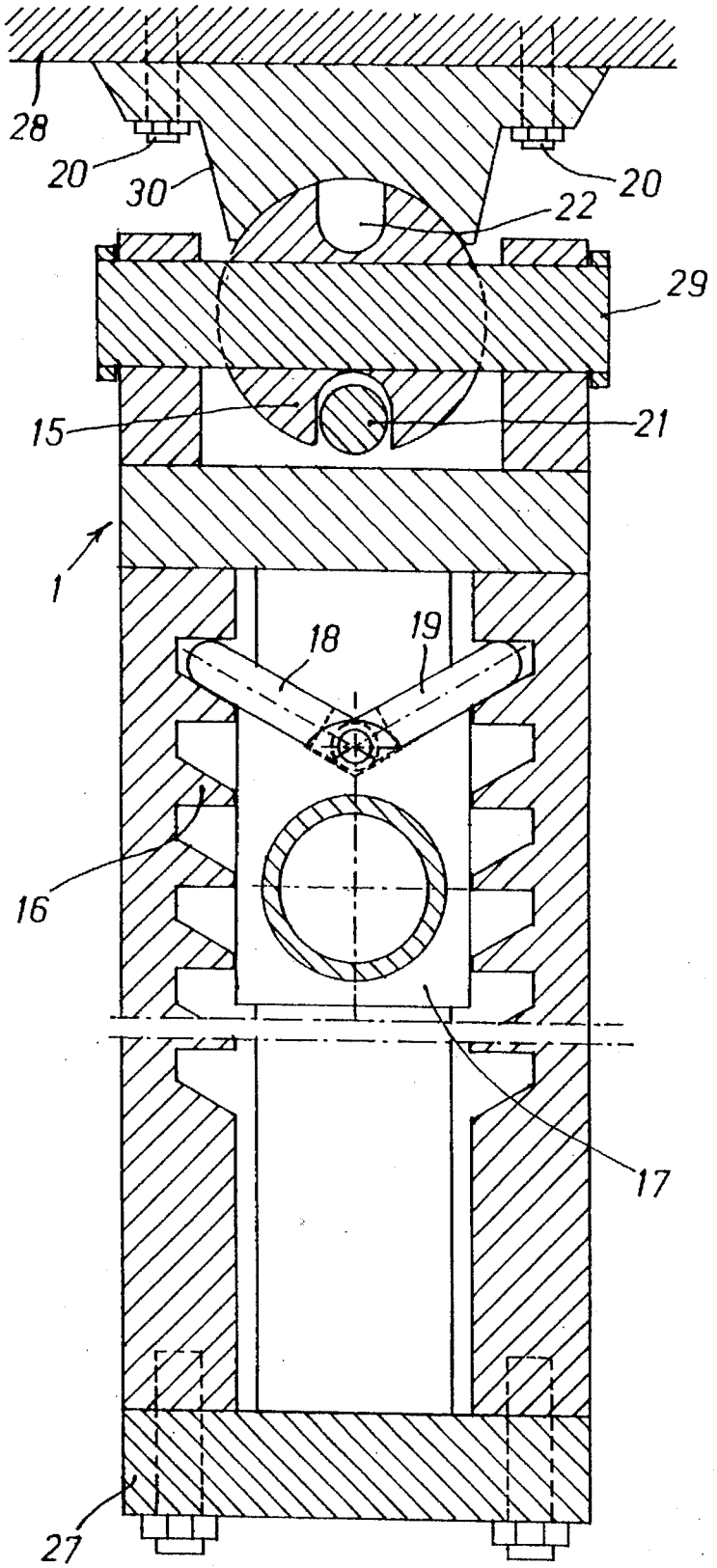
FIG. 3 is a cross section view through a load-bearing column, the slidable bearing means, and the one-way movable coupling means.
Figure 4:
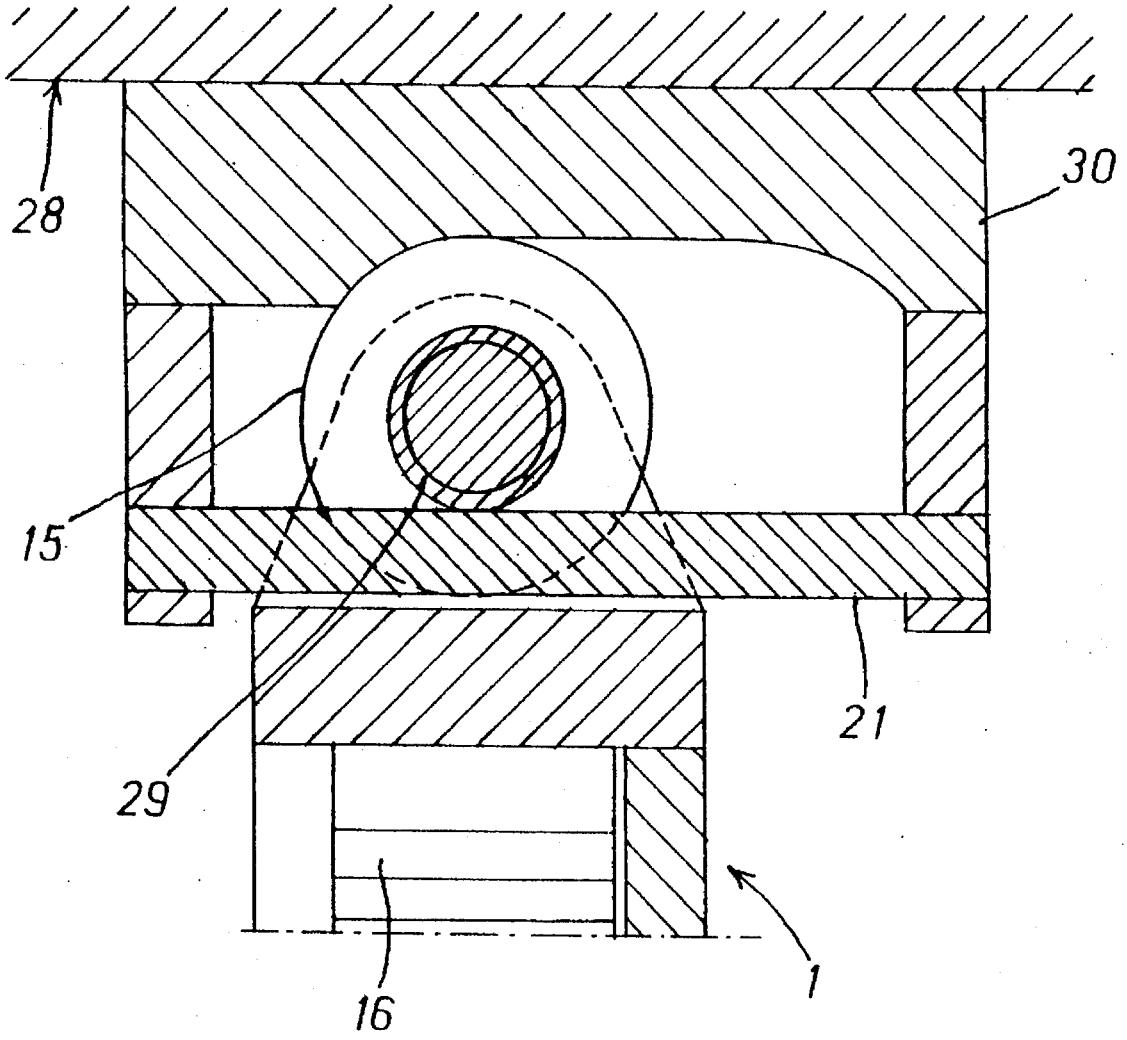
FIG. 4 is a cross section view of the slidable bearing means.

As better seen in FIGS. 3 and 4, such slidable bearing means comprises a ball 15 housed inside the column and rotatable about a through pin 29 in a plane parallel to the longitudinal axis of the hollow column, and guide channels 30, shaped like an overturned U and secured to the base of block 28 of the elevated structure by anchoring means 20, e.g. bolts or the like.

The purpose of the guide channels 30 is that of guiding the ball movements when this latter is being moved or displaced by the rotation about the pin 29.

Moreover the overturned U shape of the guide channels 30 laterally retains the ball 15 during the translation thereof, by preventing the lateral sliding of block 28, and safety tracks or bars 21 block the bottom of the ball in case of yielding of the lower portion of the load-supporting structure.

A groove 22 circumferentially extending on the ball 15, in a plane that is orthogonal to the ball rotation axis, allows the ball to rotate without interference with the safety track 21 which remains spaced from the ball 15 in normal operation.

The hollow columns 1, 2, 3, 4 are connected to one another by pairs, i.e. 1 with 3 and 2 with 4 in the Figures, by elongated arcuated members 5 and 6, preferably of steel and having circular cross sections. The ends of the flexible arcuated members 5 and 6 are fastened to the hollow columns 1, 2, 3, 4 at restrained joints 31, 32, 33, 34 in the hollow columns, preferably by cooling with liquid nitrogen the member ends to be restrained.

Preferably, the ends of the arcuated members 5, 6 are provided with a straight portion for making easier their positioning into the restrained joints 31, 32, 33, 34, with the length of the straight portions depending on the particular embodiment.

Such cooling process with liquid nitrogen can also be used for the permanent and fixed connection of all the remaining parts of the load-supporting structure, such as the pins, etc.

Each hollow column 1, 2, 3, 4 contains a one-way movable member 17 equipped with a pair of foldable bars 18 and 19, and the inner surface of the column is provided with a number of pawls or teeth 16 cooperating with such foldable bars 18 and 19 in a sort of ratchet wheel arrangement for allowing a downward only motion of the movable member 17.

In each column 1, 2, 3, 4 a lower closing member 27 enables the movable members 17 to be fitted thereinto and subsequently preventing their coming out.

From said movable members 17 provided on each column 1, 2, 3, 4, flexible steel beams 7, 8, 9, 10 branch off, whose free ends rest on as many bearing means interposed between the lower ends of said beams and the upper base of the reinforced concrete supporting pillars 35, 36, 37, 38.

Figure 5:
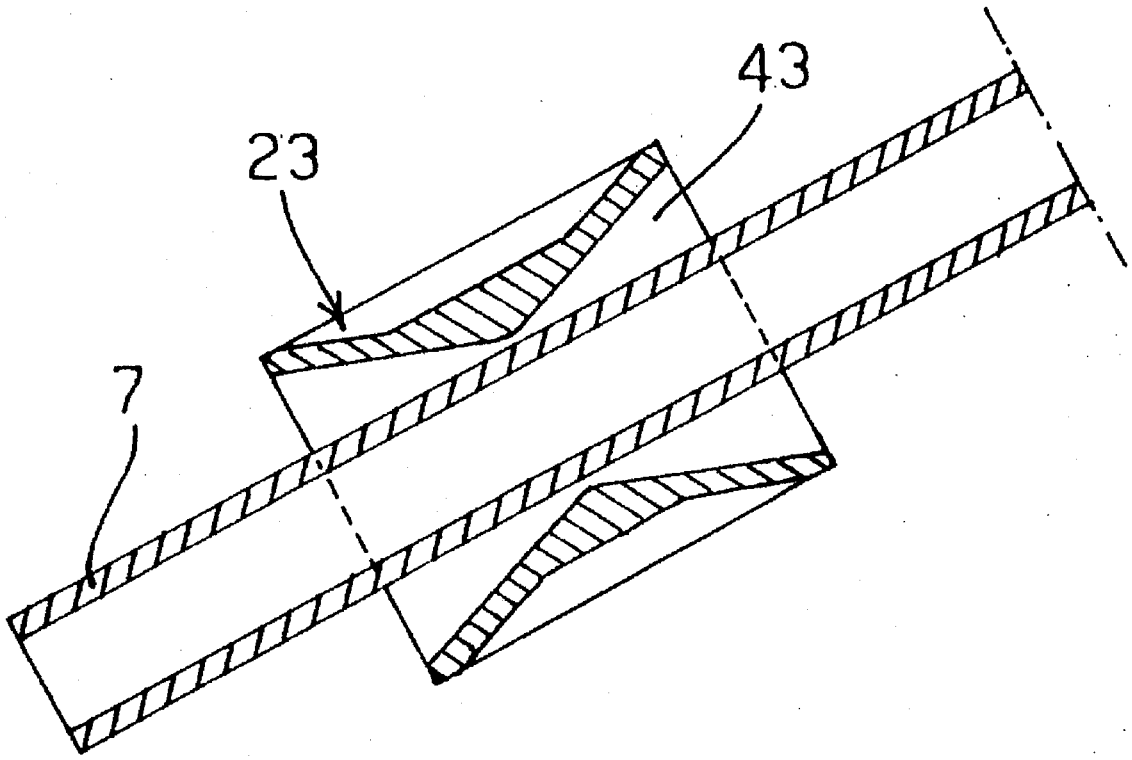
FIG. 5 is a cross section view of a guide member and the corresponding beam.

Such bearing means is formed by coupling U-shaped steel blocks 39, 39'; 40, 40'; 41, 41'; 42, 42' parallely located over the reinforced concrete supporting pillars 35, 36, 37, 38, with rotating pins 11, 12, 13, 14 of guide members 23, 24, 25, 26 respectively. FIG. 5 shows a cross section of one of such guide members 23, 24, 25, 26 for beams having a circular cross section, inside which a bore 43 is provided for the passage of the corresponding flexible beams, such passage having a conic cross section decreasing from both the open ends toward the bore center. Moreover the minimum diameter of the bore 43 at its center is also slightly larger than the beam outer diameter, to allow for the sliding of the beam free ends during the structure displacement.

The two-cone cross section of the bore 43 aims to prevent large torque stresses from acting on the beams in case of earthquakes due to the possible displacement of the base of one or more of the reinforced concrete pillars. Such torsional stresses would otherwise affect the whole steel structure, thus altering the static equilibrium of the elevated construction.

The downward displacement of the movable members 17 inside the hollow columns 1, 2, 3, 4 can occur only when one or more reinforced concrete supporting pillars 35, 36, 37, 38 is subjected to subsidence, e.g. due to an earthquake.

Therefore, at the installation, the movable members 17 will be located at their maximum height, however in case of subsidence of one or more pillars, the movable members will settle at lower levels thanks to the pawls 16.

The outer diameters of each elongated member and of each beam as well as their inner diameters and the type of steel to be used are calculated as a function of the loads the structure is designed to withstand and of the desired degree of resiliency.

When heavily loaded, the flexible arcuated members 5 and 6 tend to become more open, i.e. to be flattened, thus moving the lower bases of columns 1, 2, 3, 4 away from each other and causing a slight lowering thereof. Thus a displacement of the ball 15 along the guide channel 30 accomodates the displacement of the upper portion of the Columns, that converge upwardly.

When the elevated construction is subjected outstanding stresses, e.g. due to a large number of heavy vehicles running along the elevated construction, the resulting lowering of the structure causes a sliding of the beams 7, 8, 9, 10 within the bored guide members 23, 24, 25, 26 and a rotation thereof about pins 11, 12, 13, 14, with respect to the pairs of U-shaped blocks 39, 39'; 40, 40'; 41, 41'; 42, 42'.

What is claimed is:

1. An aseismatic load-supporting structure for supporting an elevated or raised construction, comprising a block of the elevated structure, a plurality of reinforced concrete base pillars, a plurality of hollow metal columns in a substantially parallel arrangement, supporting the base of said block through slidable bearing means and interconnected two by two through flexible arcuated members, and flexible arcuated beams, each having one end connected to one of said base pillars through bearing means at the tops of said base pillars respectively, and the other end connected to one of said hollow metal columns through a coupling member one-way axially movable inside said hollow metal column.

2. An aseismatic load-supporting structure according to claim 1, wherein the bearing means at the tops of said base pillars are provided with guide members each having a bore for the passage of the associated flexible arcuated beam, with said guide members being pivotally secured to the tops of said base pillars by pairs of of U-shaped brackets.

3. An aseismatic load-supporting structure according to claim 2, wherein said bore in each of said guide members has a conic cross section decreasing from open ends toward the center of the bore, with the minimum diameter of the bore at its center being slightly larger than the outer diameter of the flexible arcuated beam thereby allowing the sliding of said arcuated beam end during a structure displacement.

4. An aseismatic load-supporting structure according to claim 1, wherein the inside of said hollow columns is provided with pawls cooperating with foldable locking bars of said one-way axially movable coupling members for preventing the upwardly return of said movable coupling members.

5. An aseismatic load-supporting structure according to claim 1, wherein said sliding bearing means are located between the upper ends of said hollow metal columns and the lower base of the block of the elevated construction, and comprises a ball pivotally fixed by a pin to the end of each hollow metal column, and a guide channel shaped like an overturned U and fixed to the lower base of said block, whereby the column upper ends can be moved towards and away from each other during subsidence and raising displacements of the elevated construction.

6. An aseismatic load-supporting structure according to claim 5, wherein said ball is provided with a circumferential groove for engaging a safety track, whereby said ball can rotate without interference with said safety track and is nevertheless retained in case of subsidence of the base pillars.

* * * * *